US012716677B2

(12) United States Patent
Eldred

(10) Patent No.: US 12,716,677 B2
(45) Date of Patent: Aug. 25, 2026

(54) BUSHINGS FOR ARCHERY BOWS AND RELATED APPARATUSES

(71) Applicant: Hoyt Archery, Inc., Salt Lake City, UT (US)

(72) Inventor: Eric W. Eldred, Tooele, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 176 days.

(21) Appl. No.: 18/807,432

(22) Filed: Aug. 16, 2024

(65) Prior Publication Data

US 2026/0049788 A1 Feb. 19, 2026

(51) Int. Cl.
*F41B 5/14* (2006.01)

(52) U.S. Cl.
CPC ..... *F41B 5/1403* (2013.01)

(58) Field of Classification Search
CPC ..... F41B 5/1426; F41B 5/144; F41B 5/1403; F16B 13/124
See application file for complete search history.

(56) References Cited

U.S. PATENT DOCUMENTS 3,412,725 A * 11/1968 Hoyt, Jr. ..... F41B 5/1426 124/84
3,721,506 A * 3/1973 Anderson ..... F01D 5/3038 411/63
4,135,486 A * 1/1979 Enomoto ..... F41B 5/1426 124/89
4,570,608 A * 2/1986 Masterfield ..... F41B 5/1426 188/378
4,640,258 A * 2/1987 Penney ..... F41B 5/1426 124/24.1
5,005,554 A * 4/1991 Shepley ..... F41B 5/14 124/44.5
5,231,970 A * 8/1993 Ploot ..... F41B 5/0052 124/23.1
5,431,590 A * 7/1995 Abbas ..... F41B 5/14 124/90
9,909,833 B1 * 3/2018 Huang ..... F41B 5/1426
11,181,335 B1 * 11/2021 McPherson ..... F41B 5/148
11,767,804 B1 * 9/2023 Choudhary ..... F02F 1/18 123/193.2
2010/0313864 A1 * 12/2010 Gardner ..... F41B 5/10 124/1
2011/0252924 A1 * 10/2011 Federighi ..... B67B 7/0423 81/3.45
2011/0303203 A1 * 12/2011 Jolley ..... F41B 5/1426 29/428
2012/0025020 A1 * 2/2012 Plithides ..... C08L 65/02 16/385
2013/0233292 A1 * 9/2013 Gardner ..... F41B 5/1426 124/25.6

(Continued)

*Primary Examiner* — Joshua E Freeman

(57) ABSTRACT

An archery bow includes a riser and a bushing coupled to the riser. The bushing includes a bore, a drive feature, and a threaded feature. The drive feature is disposed within the bore. The threaded feature is disposed between the aperture and the drive feature. The bushing can include a body having a first end and a second end. A flange can be formed or defined at the first end. The drive feature can be disposed at the second end. The threaded feature can be internally disposed within the bore. The bushing can have an external threaded feature.

20 Claims, 5 Drawing Sheets

(56) References Cited

U.S. PATENT DOCUMENTS

| | | | | |
|---|---|---|---|---|
| 2016/0061556 | A1* | 3/2016 | Armstrong | F41B 5/1426 124/89 |
| 2016/0061561 | A1* | 3/2016 | Challis | F41C 23/16 411/103 |
| 2016/0084607 | A1* | 3/2016 | Prater | F41B 5/148 124/88 |
| 2017/0248458 | A1* | 8/2017 | Yusuf | G01F 1/662 |
| 2018/0094894 | A1* | 4/2018 | Prater | F41B 5/105 |
| 2023/0243616 | A1* | 8/2023 | McPherson | F41B 5/1403 124/88 |
| 2023/0349659 | A1* | 11/2023 | Kitts | F41B 5/10 |

* cited by examiner

BUSHINGS FOR ARCHERY BOWS AND RELATED APPARATUSES

TECHNICAL FIELD

The present disclosure generally relates to archery equipment and specifically relates to fasteners used on archery equipment.

BACKGROUND

Archery equipment, such as recurve bows, crossbows, and compound bows, are regularly used to launch arrows and other projectiles down range at one or more targets. Subcomponents and/or accessories are coupled or affixed to the archery bow using various fasteners to improve the utility, attributes, and functionality of the archery bow. Coupling mechanisms, such as fasteners, can be improved to advantageously impact an archer's shooting experience, performance, and overall satisfaction with the archery equipment.

SUMMARY

One aspect of the present disclosure relates to an archery bow including a riser and a bushing coupled to the riser. The bushing includes a bore, a drive feature, and a threaded feature. The bore defines an aperture. The drive feature is disposed within the bore. The threaded feature is disposed between the aperture and the drive feature.

In some examples, the bore can define a blind hole in the bushing. The drive feature can define a base of the blind hole. The base can define a planar surface orthogonal to a longitudinal axis of the bore. In some examples, the aperture can be a first aperture and the bore can define a second aperture to form a through hole. The threaded feature can be disposed within the bore. The threaded feature can be a first threaded feature. The bushing can include a second threaded feature disposed on an external surface of the bushing. The first threaded feature can have a first characteristic and the second threaded feature can have a second characteristic different from the first characteristic. The drive feature can have a hexagonal cross-section. In some examples, the drive feature can define a first length. The threaded feature can define a second length. The first length can be less than the second length. In some examples, the drive feature can define a first width. The threaded feature can define a second width. The first width can be less than or equal to the second width.

Another aspect of the present disclosure relates to an archery bow including a riser and a bushing coupled to the riser. The bushing includes a body, a flange, and a drive feature. The body has a first end and a second end. The flange is disposed on the first end. The drive feature is disposed on the second end.

In some examples, the body can define a bore having a blind hole. The drive feature can define a base of the blind hole. The second end can define a planar surface extending orthogonal to a longitudinal axis of the body. The drive feature can have a sidewall spanning perpendicular to the planar surface. In some examples, the first end can include a first aperture. The second end can include a second aperture. The body can define a bore connecting the first aperture to the second aperture. The body can include an external threaded feature disposed between the first end and the drive feature. The body can include an internal threaded feature disposed between the first end and the drive feature.

The body can taper from a first thickness at the first end to a second thickness at the second end. The first thickness can be greater than the second thickness.

Yet another aspect of the present disclosure includes a bushing for an archery bow. The bushing includes a body, a threaded feature, and a drive feature. The body has a bore. The threaded feature is disposed within the bore. The threaded feature has a first width. The drive feature is disposed within the bore. The drive feature has a second width. The first width is greater than or equal to the second width.

In some examples, the bushing further includes a flange. The threaded feature can be disposed between the flange and the drive feature.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
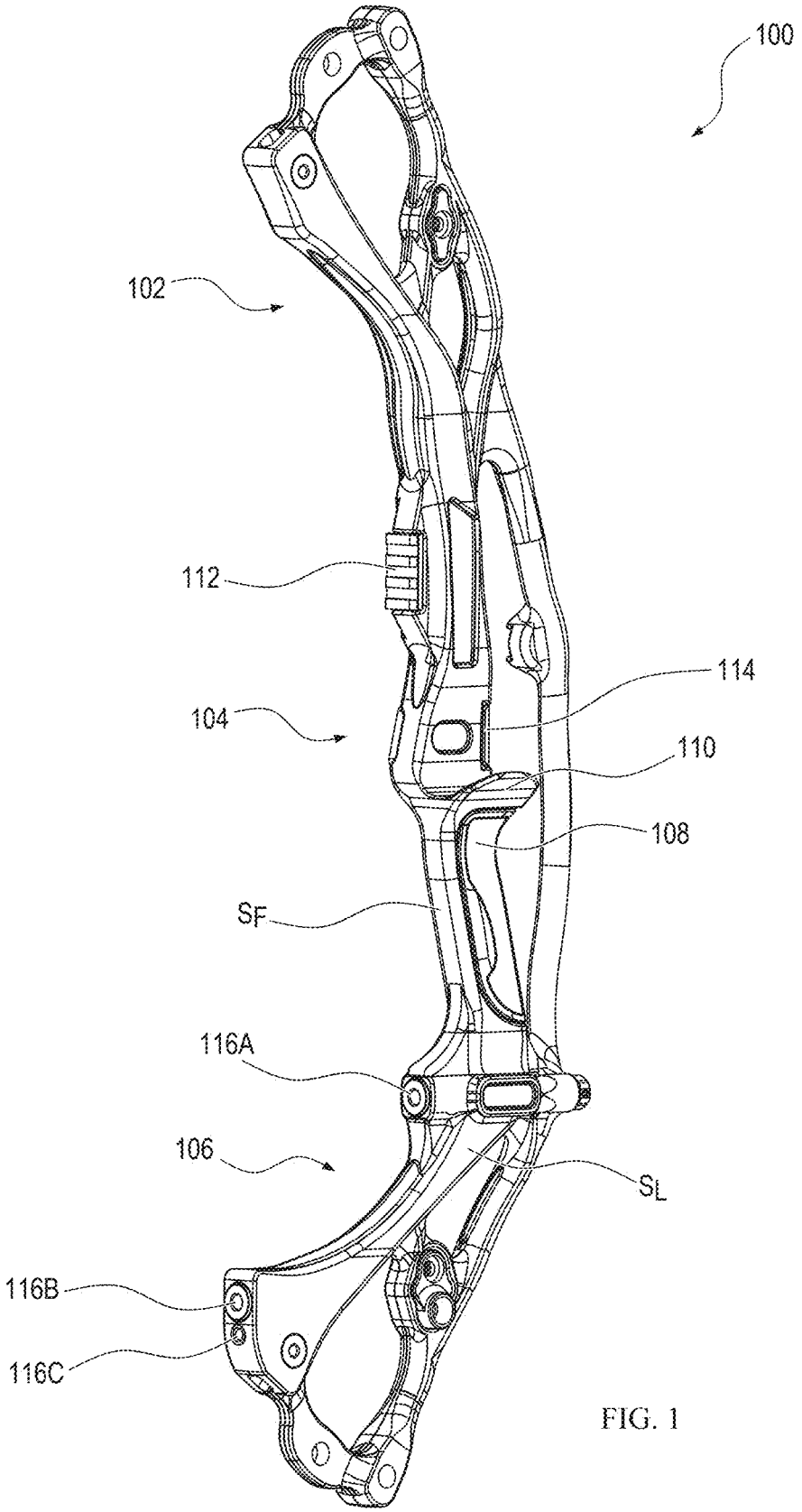
FIG. 1 is a perspective side view of a riser for an archery bow, according to some embodiments.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

In some examples, an archery bow (e.g., compound, recurve, cross, etc.) can include one or more bushings. For example, an archery bow can include one or more bushings located and arranged on a riser or handle to attach a stabilizer bar or other accessory to the riser. The riser can be machined or otherwise formed out of one or more materials. For example, the riser can be machined from an aluminum alloy. In some examples, the riser can be at least partially formed and/or machined from a composite material, such as, fiberglass, carbon fiber, other composite materials, or combinations thereof.

In some examples, one or more of the bushings can include a drive feature disposed within a bore of the bushing. For example, the drive feature can be formed or otherwise defined within a base of the bushing (e.g., opposite a flange) such that a tool can be inserted into the bore, past a threaded feature, and into the drive feature to install or couple the bushing to the riser. In other words, the drive feature can be disposed within a portion of the bore that is deeper or further from the surface of the riser when the bushing is coupled to the riser than a depth of the threaded feature from the surface. The drive feature can be shaped or formed to engage a particular drive of a tool, such as, slotted, cross-slot, star (Torx®), security, hexagon, square, a combination thereof, or any other type of drive.

Disposing or forming the drive feature at the base of the bore can be advantageous. For example, the position of the drive feature deep within the bore of the bushing can provide increased stability, accuracy, and enable torque to be applied more effectively on the bushing during installation. For example, the forces applied to the bushing for installation are induced at the base of the bushing to mitigate misalignment and binding. Additionally, the drive feature can provide an engagement surface for the installation tool that is less visible to a consumer and therefore minimizes visible blemishes resultant from bushing installation.

In some examples, the archery bow can include one or more bushings. At least one of the one or more bushings can include a bore, a drive feature, and a threaded feature. The bore can extend longitudinally along the bushing and define an aperture. The drive feature can be disposed within the bore and can be accessed by a tool via the aperture. The threaded feature can be disposed between the aperture and the drive feature. For example, the threaded feature can be formed within the bore between the aperture and the drive feature. In some examples, a flange can be disposed on an end of the bushing and at least partially define the aperture. In some examples, the bore can define a blind hole, pocket-hole, or closed-hole within the bushing such that the bushing has a base or bottom wall. In some examples, the bore can define a through hole (e.g., respective apertures at respective ends of the bushing).

Additionally or alternatively, at least one of the one or more bushings can include a body, a flange, and a drive feature. The body can be cylindrical having a first end and a second end. The flange can extend away from the body and be disposed on the first end of the body. The drive feature can be disposed on the second end of the body. For example, the drive feature can be formed or otherwise defined within the body at the second end. The flange can be disposed adjacent to an exterior surface of the riser when the bushing is coupled to the riser and the drive feature can be disposed within a recess or cavity in the riser. In some examples, the recess or cavity within the riser can include threads which engage corresponding threads disposed about a periphery of the body of the bushing.

Additionally or alternatively, at least one of the one or more bushings can include a body, a threaded feature, and a drive feature. The body can define or form a bore. The threaded feature can be disposed within the bore. The threaded feature can have a first width. The drive feature can be disposed within the bore. The drive feature can have a second width. The first width can be greater than or equal to the second width. For example, the first width (width of the threaded feature) can be relatively larger than the second width (width of the drive feature) to enable insertion of a tool into the bore, past the threaded feature, to engage the drive feature.

In some examples, the bushing can include a secondary threaded feature disposed on an external surface of the bushing. The secondary or external threaded feature can have one or more characteristics unique from the primary or inner threaded feature. The one or more unique characteristics to the external threaded feature can be advantageous for optimizing engagement between a riser made from composite materials and the bushing. For example, the one or more characteristics can be thread length, root, angle, minor diameter, major diameter, depth, crest, pitch, flank, a combination thereof, or any other characteristic. For example, the major diameter of the external threaded feature can generate an interference fit within the blind hole or through hole of the composite archery bow riser. The interference fit can couple the bushing within the blind hole or through hole and provide engagement limiting or preventing removal of the bushing from the blind hole or through hole. For example, the interference between the external threaded feature and the composite archery riser can resist rotation that would otherwise decouple or unthread the bushing from the blind hole or through hole of the composite archery bow riser. In some examples, the interference can be between 0.125 millimeters (mm) and 0.765 mm, such as, an interference of 0.435 mm. In other words, the major diameter of the external threaded feature can be between 0.125 mm and 0.765 mm larger than an outer diameter (OD) of the blind hole or through hole of the composite archery bow riser receiving the bushing. In some examples, the external threaded feature can taper along the thread length. The major diameter can be measured as the largest major diameter along the thread length. Additionally, or alternatively, the major diameter can be measured as the average major diameter along the thread length. Additionally, or alternatively, the major diameter can be measured as the smallest major diameter along the thread length. In some examples, the blind hole or through hole within the composite riser can be tapered to match or substantially match the tape of the external threaded portion and/or the bushing.

The present description provides examples, and is not limiting of the scope, applicability, or configuration set forth in the claims. Thus, it will be understood that changes may be made in the function and arrangement of the bushings discussed herein without departing from the spirit and scope of the disclosure, and various embodiments may omit, substitute, or add other features or subcomponents as appropriate. For instance, the flange or other features described with respect to certain embodiments may be combined in other embodiments or omitted entirely. The specific examples shown in the figures and described herein should not, therefore, be considered to limit the breadth of possible embodiments and combinations of possible embodiments contemplated by the present disclosure.

Referring now to the figures in detail, FIG. 1 shows a compound archery bow riser 100. The riser 100 can be machined or otherwise formed out of one or more materials. For example, the riser 100 can be machined from an aluminum alloy. In some examples, the riser 100 can be at least partially formed and/or machined from a composite material, such as, fiberglass, carbon fiber, other composite materials, or combinations thereof.

The archery bow riser 100 includes one or more structures or features capable of facilitating various functions associated with operation of an archery bow. For example, the archery bow riser 100 can include an upper portion 102, a handle portion or middle portion 104, and a lower portion 106. The upper portion 102 can couple to one or more bow limbs (not shown) to facilitate energy storage when the archery bow is used to launch projectiles. The one or more bow limbs can be coupled to the upper portion 102 via a limb pocket (not shown) affixed to the upper portion 102. The middle portion 104 can be disposed between the upper portion 102 and the lower portion 106. The middle portion 104 can include a grip or handle 108 positioned to enable an archer to grip the archery bow riser 100 during operation of the archery bow. In some examples, the middle portion 104 can include an arrow shelf 110, a sight mounting feature 112, and/or an arrow rest mounting feature 114. The lower portion 106 can couple to one or more bow limbs (not shown) to facilitate energy storage when the archery bow is used to launch projectiles. The one or more bow limbs can be coupled to the lower portion 106 via a limb pocket (not shown) affixed to the lower portion 106.

In some examples, the one or more of the upper, middle, and lower portions 102, 104, 106 can include one or more bushings coupled thereto. For example, the lower portion 106 can include one or more bushings 116A, 116B, 116C disposed within cavities or recesses formed within the archery bow riser 100. For example, the cavities or recesses can be blind holes or through holes machined or otherwise formed within the archery bow riser 100. Each respective blind hole or through hole can receive a bushing therein. As described herein, each of the one or more bushings 116A, 116B, 116C can include one or more features that engage the archery bow riser 100 within the blind hole or through hole to couple the bushing to the archery bow riser 100.

While three bushings 116A-116C are shown in FIG. 1 and described herein, the archery bow riser 100 can include additional bushings or fewer bushings in other embodiments. Each of the one or more bushings 116A-116C can be used to affix or otherwise couple one or more components or accessories to the archery bow riser 100. For example, one or more of the bushings 116A-116C can be used to affix a stabilizer, a bow-stand, a quiver, a bow limb, a rest, a combination thereof, or any other component or accessory to the archery bow riser 100. In some examples, one or more of the bushings 116A-116C can be coupled within respective blind holes or through holes machined or otherwise formed within the archery bow riser 100. In some examples, one or more of the bushings 116A-116C can be disposed on a forward-facing surface $S_F$ of the archery bow riser 100 (e.g., a surface facing downrange when a projectile is launched). Additionally, or alternatively, one or more of the bushings 116A-116C can be disposed on a lateral-facing surface $S_L$ of the archery bow riser 100. Additionally, or alternatively, one or more of the bushings 116A-116C can be disposed on a rearward-facing surface of the archery bow riser 100 (e.g., a surface facing opposite the forward-facing surface $S_F$).

The figures illustrate example archery apparatuses that may be used in conjunction with the principles and teachings of the present disclosure. Thus, while the archery bow riser described herein is a compound bow riser, it will be understood by those having ordinary skill in the art that the components of the archery bow riser, accessories, and related methods and apparatuses included in embodiments of the present disclosure may be applied to components and apparatuses in compound bows, recurve bows, crossbows, their accessories, and other equipment related to archery. Similarly, archery equipment applying the teachings of the present disclosure does not need to implement all of the features of the present disclosure. For example, in some embodiments, the bushing may not comprise a flange, so features associated with the flange may be omitted from the bushing.

Figure 2A:
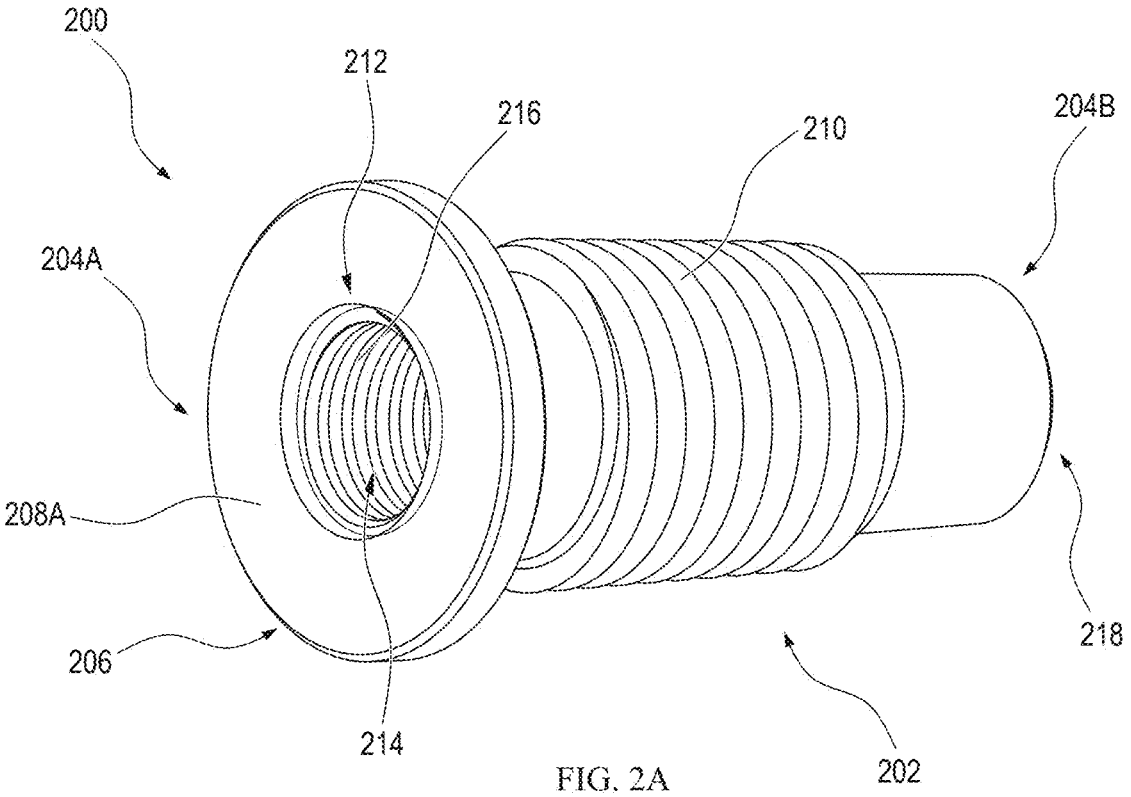
FIG. 2A is a perspective front view of a bushing of an archery bow, according to some embodiments.
Figure 2B:
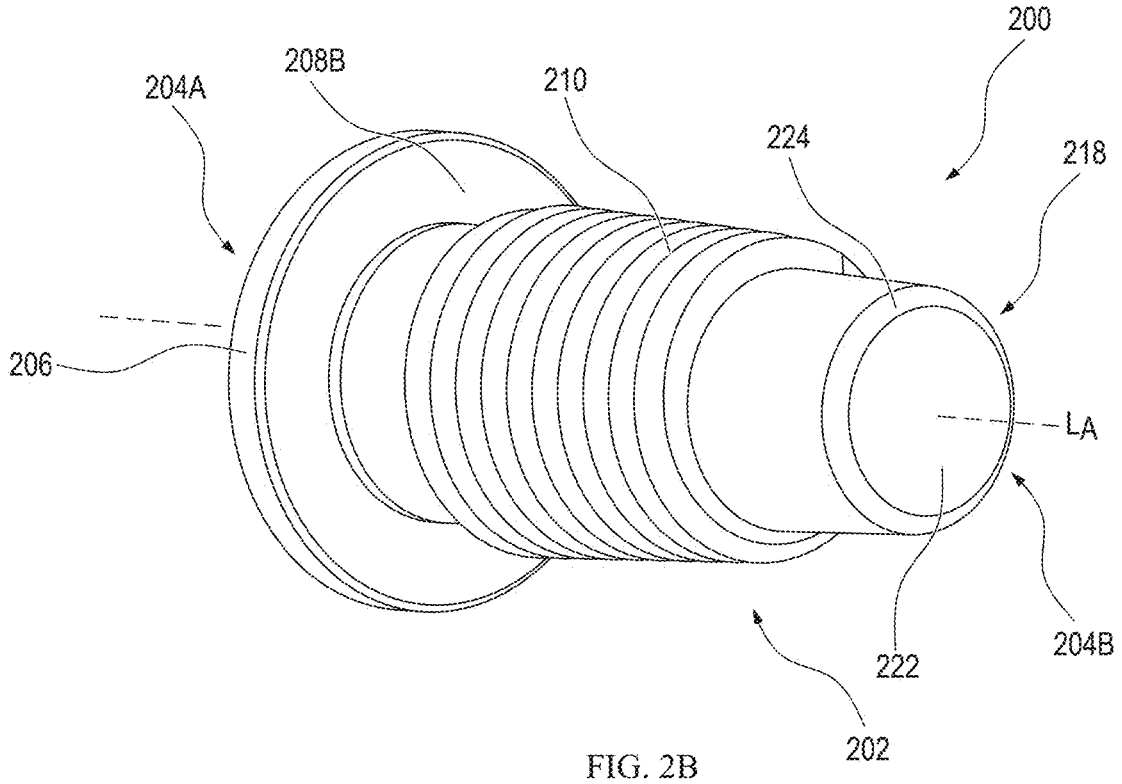
FIG. 2B is a perspective rear view of the bushing, according to some embodiments.
Figure 2C:
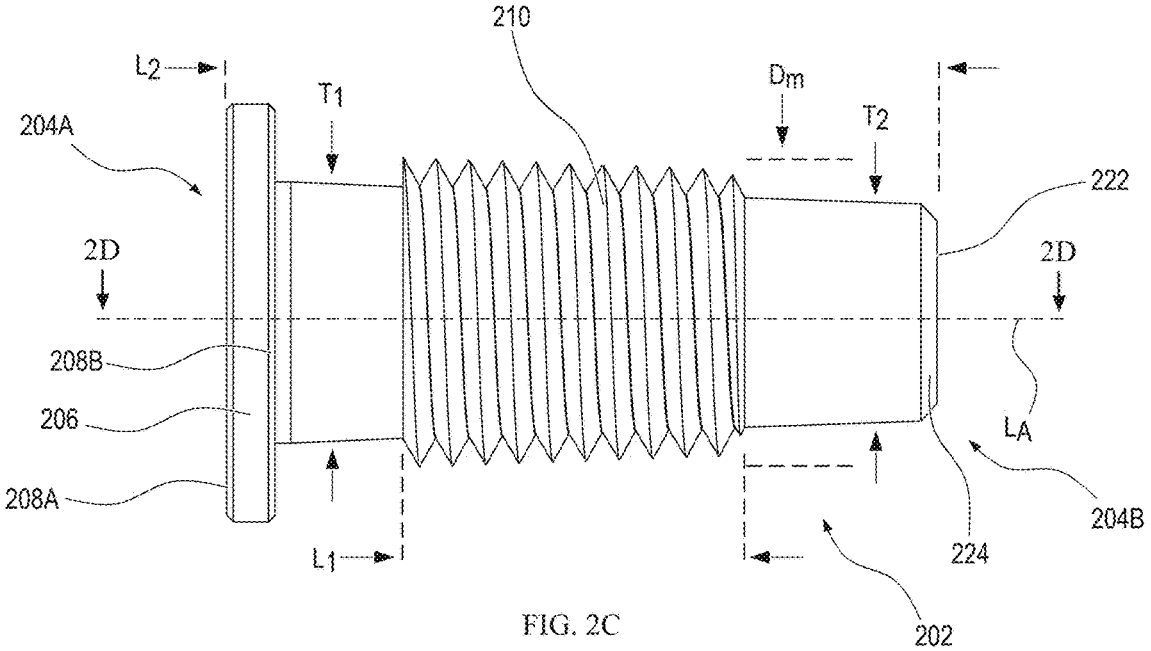
FIG. 2C is a side view of the bushing, according to some embodiments.
Figure 2D:
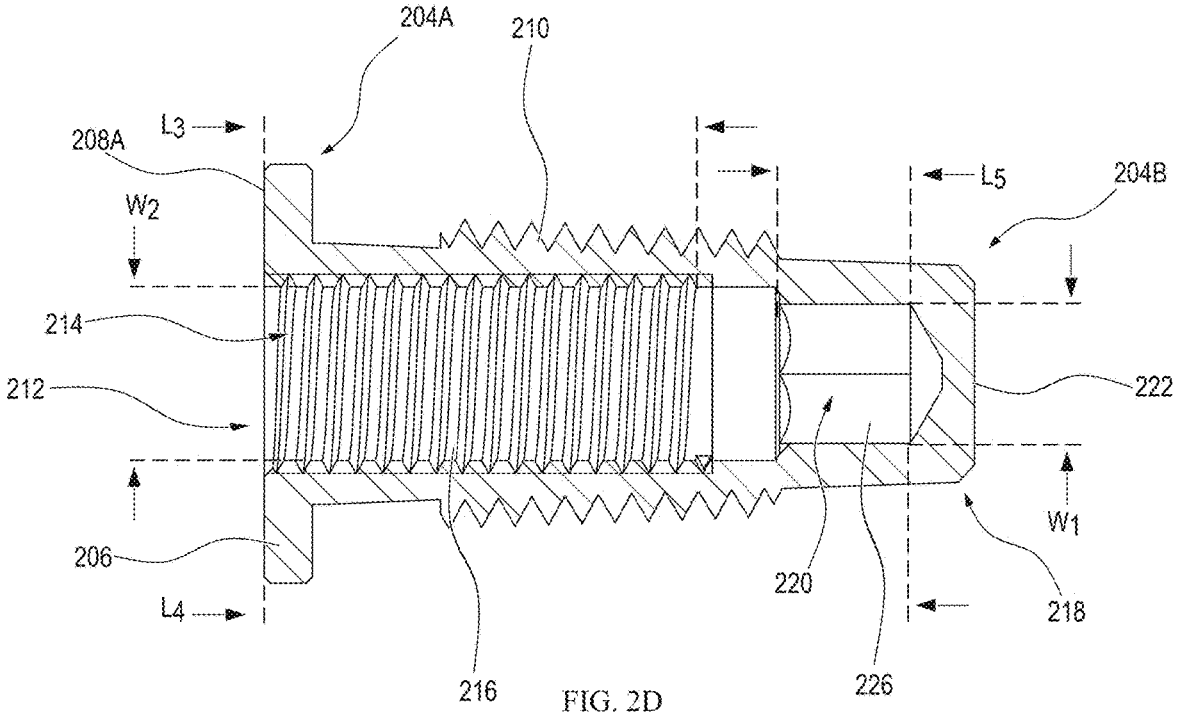
FIG. 2D is a cross-sectional side view of the bushing, according to some embodiments.

FIGS. 2A-2C show a bushing 200 for use with archery equipment, such as, an archery bow limb or an archery bow riser (e.g., archery bow riser 100 shown in FIG. 1). FIG. 2D shows a cross-sectional view of the bushing 200 taken through the section lines 2D-2D shown in FIG. 2C. The bushing 200 can include a body 202 having a first end 204A and a second end 204B. In some examples, the body 202 can be cylindrical in shape and can be substantially symmetric about a longitudinal axis $L_A$. The body 202 can have one or more features or attributes. For example, the body 202 can include a flange 206 disposed at the first end 204A of the body 202. In some examples, the flange 206 can extend radially from the longitudinal axis $L_A$ and can be substantially symmetric about the longitudinal axis $L_A$. In some examples, the flange 206 can include one or more planar surfaces 208A, 208B positioned to at least partially abut the archery bow riser or a component or accessory coupled to the archery bow riser via the bushing 200. For example, a stabilizer or other archery accessory can abut the flange 206 when coupled to the archery bow riser via the bushing 200. In some examples, the one or more planar surfaces 208A, 208B can be orthogonal to the longitudinal axis $L_A$.

In some examples, the body 202 can define an external threaded feature 210 disposed between the first end 204A and the second end 204B. The external threaded feature 210 can have one or more characteristics unique to the external threaded feature 210. For example, the one or more characteristics unique to the external threaded feature 210 can be thread length, root, angle, minor diameter, major diameter, depth, crest, pitch, flank, a combination thereof, or any other characteristic. The one or more unique characteristics to the external threaded feature 210 can be advantageous for optimizing engagement between an archery bow riser made from composite materials and the bushing 200. For example, a major diameter $D_m$ of the external threaded feature 210 can generate an interference fit within the blind hole or through hole of the composite archery bow riser 100. The interference fit can couple the bushing 200 within the blind hole or through hole and provide engagement limiting or preventing removal of the bushing 200 from the blind hole or through hole. For example, the interference between the external threaded feature 210 and the composite archery riser 100 can resist rotation that would otherwise decouple or unthread the bushing 200 from the blind hole or through hole of the composite archery bow riser 100.

In some examples, the interference can be between 0.125 millimeters (mm) and 0.765 mm, such as, an interference of 0.435 mm. In other words, the major diameter $D_m$ of the external threaded feature 210 can be between 0.125 mm and 0.765 mm larger than an outer diameter (OD) of the blind hole or through hole of the composite archery bow riser 100 receiving the bushing 200. In some examples, the external threaded feature 210 can taper along the thread length (see first length $L_1$). The major diameter $D_m$ can be measured as the largest major diameter along the thread length. Additionally, or alternatively, the major diameter $D_m$ can be measured as the average major diameter along the thread length. Additionally, or alternatively, the major diameter $D_m$ can be measured as the smallest major diameter along the thread length. In some examples, the blind hole or through hole within the composite riser 100 can be tapered.

The external threaded feature 210 can occupy or define more than half of the external surface of the body 202 yet, in some examples, may not occupy the entirety of the external surface of the body 202. For example, the external threaded feature 210 can have a first length $L_1$ and the body 202 can have a second length $L_2$. The first length $L_1$ can be at least 9 mm, between about 9 mm and about 10 mm, between 10 mm and about 11 mm, between about 11 mm and about 12 mm, or greater than about 12 mm. The second length $L_2$ can be at least 20 mm, between about 20 mm and about 25 mm, between 25 mm and about 30 mm, between about 30 mm and about 35 mm, or greater than about 35 mm. As such, in some examples, the first length $L_1$ can be less than the second length $L_2$. In some examples, the first length $L_1$ can be between half to three-quarters of the second length $L_2$. In other words, the second length $L_2$ can be between 1.25 times greater to 2 times greater than the first length $L_1$. In some examples, the external surface of the body 202 can be devoid of threads (e.g., relatively smooth) adjacent to the second end 204B to enable the second end 204B to be more easily inserted and aligned within a hole or cavity formed within the archery bow riser before the external threaded feature 210 engages with the riser 100.

In some examples, the body 202 can define an aperture 212 and the component or accessory can include a threaded stud (not shown) receivable within the aperture 212. For example, a channel or bore 214 defined within the body 202 can be accessible via the aperture 212. In some examples, the bore 214 can be a blind hole (see FIGS. 2A-2D). In some examples, the bore 214 can be a through hole (see FIGS. 3A-3D). The bore 214 can enable access to a drive feature (see drive feature 220 in FIG. 2D). For example, a hand tool, drill accessory, or other tool can be inserted into the bore 214 and engage the drive feature 220 to rotate the bushing 200 as a coupling/decoupling mechanism for installing/uninstalling the bushing 200 relative to the archery bow riser.

In some examples, the bore 214 can include an internal threaded feature 216 disposed between the first end 204A and the second end 204B. In other words, the internal threaded feature 216 can be disposed within the bore 214 and between the flange 206 and a base 218 of the body 202. The internal threaded feature 216 can have one or more characteristics unique to the internal threaded feature 216. For example, the one or more characteristics unique to the internal threaded feature 216 can be thread length, root, angle, minor diameter, major diameter, depth, crest, pitch, flank, a combination thereof, or any other characteristic. In some examples, the external threaded feature 210 can have one or more characteristics similar to or the same as one or more characteristics of the internal threaded feature 216. In some examples, the external threaded feature 210 can have one or more characteristics different from one or more characteristics of the internal threaded feature 216. For example, the internal threaded feature 216 can have a first pitch that is different from a second pitch of the external threaded feature 210. Additionally, or alternatively, the internal threaded feature 216 can have a first differential defined by the minor and major diameters that is different from a second differential defined by the minor and major diameters of the external threaded feature 210.

In some examples, the internal threaded feature 216 can occupy or define more than half, yet not the entirety, of the bore 214. For example, the internal threaded feature 216 can have a third length $L_3$ and the bore 214 can have a fourth length $L_4$. In some examples, the third length $L_3$ can be between half to three-quarters of the fourth length $L_4$. In other words, the fourth length $L_4$ can be between 1.25 times greater to 2 times greater than the third length $L_3$. The third length $L_3$ can be at least 12 mm, between about 12 mm and about 14 mm, between 14 mm and about 16 mm, between about 16 mm and about 18 mm, or greater than about 18 mm. The fourth length $L_4$ can be at least 18 mm, between about 18 mm and about 20 mm, between 20 mm and about 22 mm, between about 22 mm and about 24 mm, or greater than about 24 mm. In some examples, the bore 214 can be devoid of threads adjacent to the base 218 and second end 204B. That is, the bore 214 can define or form a drive feature 220 (see FIG. 2D) near the second end 204B having one or more planar surfaces devoid of threads.

In some examples, the base 218 can include one or more planar surfaces 222 extending substantially orthogonal to the longitudinal axis $L_A$. In some examples, the one or more planar surfaces 222 of the base 218 can be parallel to the one or more planar surfaces 208A, 208B of the flange 206. In some examples, the one or more planar surfaces 222 can extend radially from the longitudinal axis $L_A$ and can be substantially symmetric about the longitudinal axis $L_A$. In some examples, the base 218 can include a periphery having an edge 224 that is chamfered, rounded, sunk, concaved, beveled, or a combination thereof. The characteristic of the edge 224 can be beneficial, for example, by providing clearance and mitigating interference between the bushing 200 and the riser (e.g., a countersink within a blind hole of the riser). In some examples, the edge 224 can be substantially symmetric about the longitudinal axis $L_A$.

In some examples, the body 202 can taper along its length (e.g., length $L_2$). For example, the first end 204A can have a first thickness $T_1$ and the second end 204B can have a second thickness $T_2$ that is less than the first thickness $T_1$. The taper can be constant along the length of the body 202 in some examples. In other examples, the taper can be nonconstant or otherwise discontinuous along the length of the body 202. For example, the taper can be interrupted or bisected by the external threaded feature 210 and/or another feature formed or defined on the body 202. The first thickness $T_1$ can be at least 7 mm, between about 7 mm and about 9 mm, between 9 mm and about 11 mm, between about 11 mm and about 13 mm, or greater than about 13 mm. The second thickness $T_2$ can be at least 5 mm, between about 5 mm and about 7 mm, between 7 mm and about 9 mm, between about 9 mm and about 11 mm, or greater than about 11 mm. As such, in some examples, the first thickness $T_1$ can be greater than the second thickness $T_2$. The second thickness $T_2$ can be greater than about 75%, between about 75% and about 80%, between 80% and about 85%, between about 85% and about 90%, or greater than about 90% of the first thickness $T_1$.

The bushing 200 includes the drive feature 220 formed or otherwise defined within the bore 214. The drive feature 220 can provide an interface for the head of a tool (e.g., a tool head configured to engage a slotted, cross-slot, star (Torx®), security, hexagon, square, a combination thereof, or any other type of drive) to enable installation/rotation of the bushing 200 relative to the archery bow riser (e.g., archery bow riser 100). For example, as depicted in FIG. 2D, the drive feature 220 can form or define a hexagonal engagement such that a hex drive can be at least partially disposed within the drive feature 220. A tool can be at least partially inserted into the bore 214, past the internal threaded feature 216, and into the drive feature 220. In some examples, the drive feature 220 can be formed or defined within the bore 214 by one or more planar sidewalls 226 (e.g., 6 sidewalls for a hexagonal cross-section configuration) within the bore 214 and adjacent the base 218. Thus, the drive feature 220 is disposed nearer the second end 204B than the first end 204A, despite the drive feature 220 being accessible via the aperture 212 formed within the first end 204A. The one or more planar sidewalls 226 can be parallel to the longitudinal axis $L_A$ of the body 202. In some examples, the one or more planar sidewalls 226 can be perpendicular to the one or more planar surfaces 222.

The drive feature 220 has a fifth length $L_5$ that is less than, or equal to, the third length $L_3$ of the internal threaded feature 216. The fifth length $L_5$ can be at least 4 mm, between about 4 mm and about 5 mm, between 5 mm and about 6 mm, between about 6 mm and about 7 mm, or greater than about 7 mm. The fifth length $L_5$ can be greater than about 30%, between about 30% and about 40%, between 40% and about 50%, between about 50% and about 60%, or greater than about 60% of the third length $L_3$.

The drive feature 220 has a first width $W_1$ that is less than, or equal to, a second width $W_2$ of the internal threaded feature 216 such that a tool can be inserted into the bore 214, past the internal threaded feature 216, and into the drive feature 220 to couple or decouple the bushing 200 to the archery bow riser. The first width $W_1$ can be at least 4 mm, between about 4 mm and about 5 mm, between 5 mm and about 6 mm, between about 6 mm and about 7 mm, or greater than about 7 mm. The second width $W_2$ can be at least 4 mm, between about 4 mm and about 5 mm, between 5 mm and about 6 mm, between about 6 mm and about 7 mm, or greater than about 7 mm. The first width $W_1$ can be greater than about 80%, between about 80% and about 85%, between 85% and about 90%, between about 90% and about 95%, or greater than about 95% of the second width $W_2$.

Figure 3A:
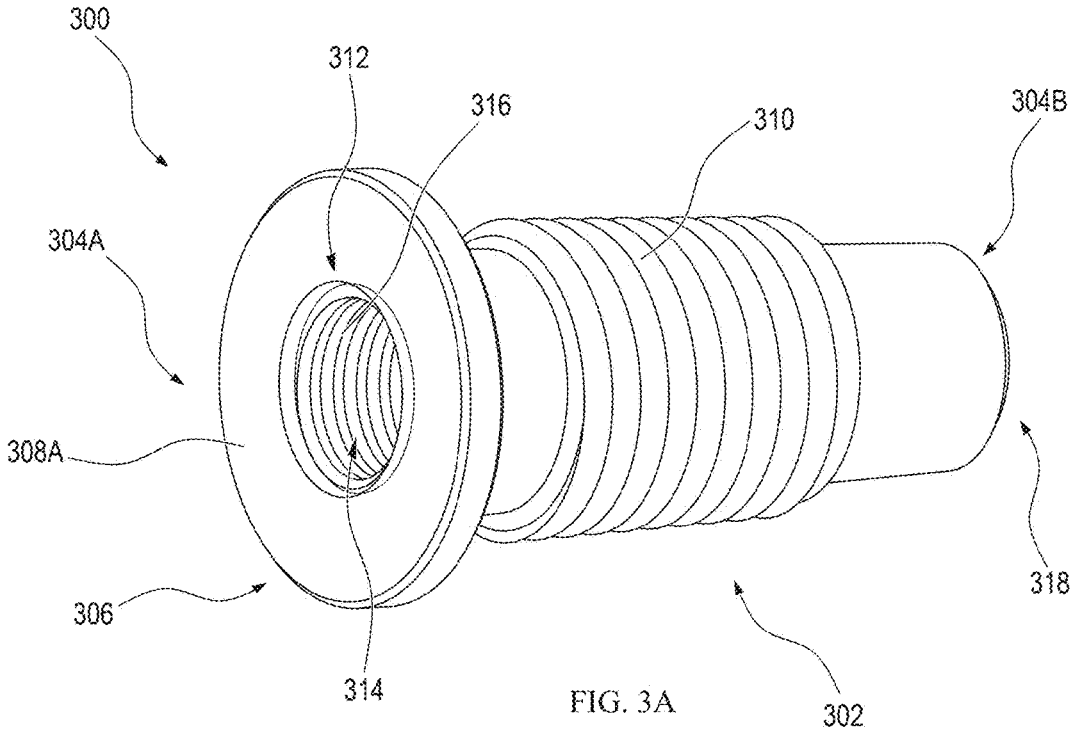
FIG. 3A is a perspective front view of a bushing of an archery bow, according to some embodiments.
Figure 3B:
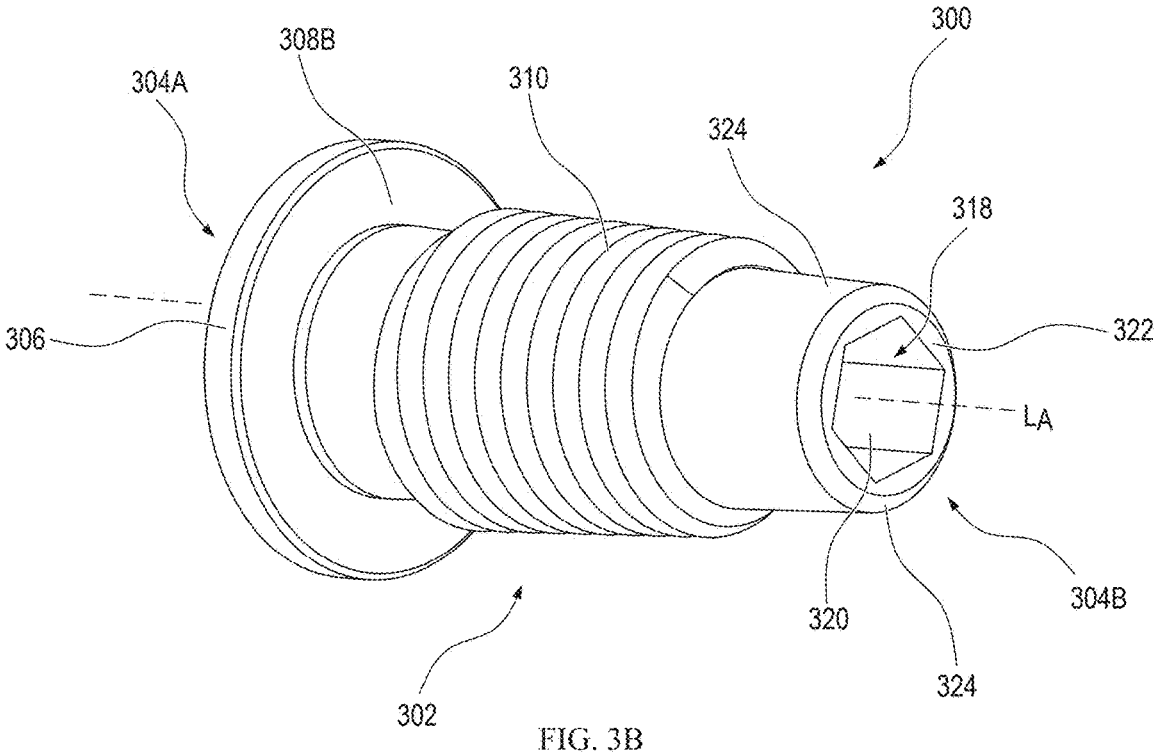
FIG. 3B is a perspective rear view of the bushing, according to some embodiments.
Figure 3C:
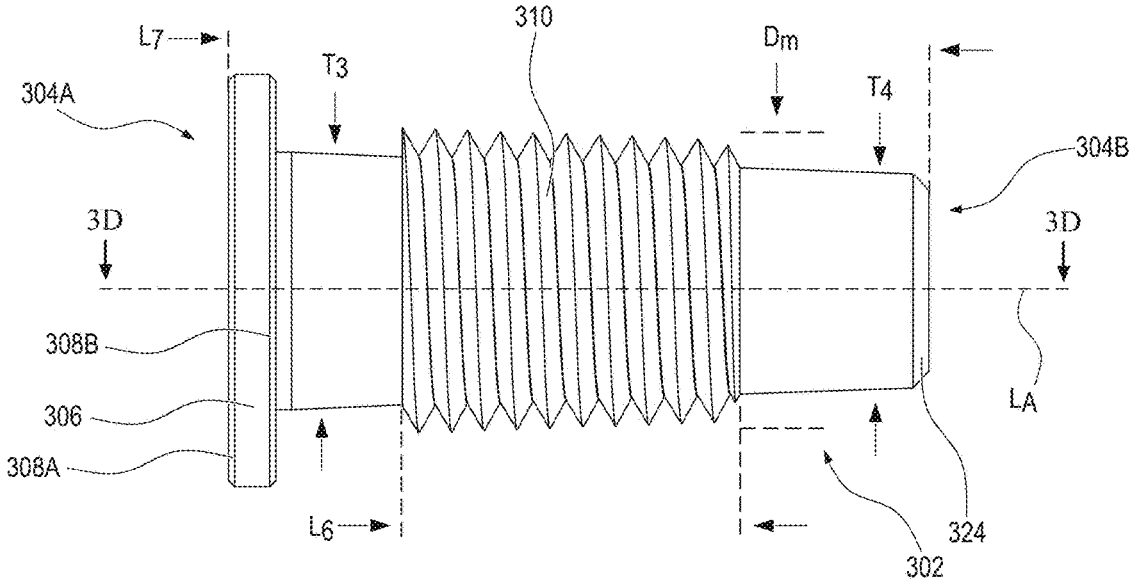
FIG. 3C is a side view of the bushing, according to some embodiments.
Figure 3D:
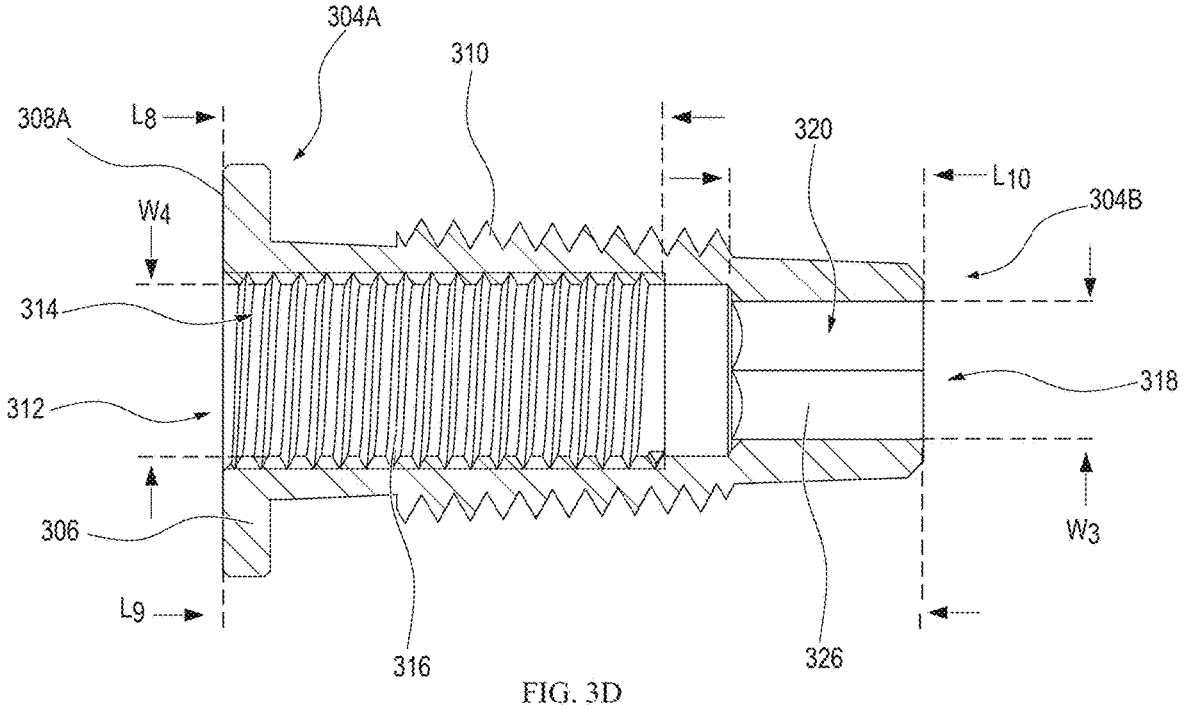
FIG. 3D is a cross-sectional side view of the bushing, according to some embodiments.

FIGS. 3A-3C show a bushing 300 for use with archery equipment, such as, an archery bow limb or an archery bow riser (e.g., archery bow riser 100 shown in FIG. 1). FIG. 3D shows a cross-sectional view of the bushing 300 taken through the section lines 3D-3D shown in FIG. 3C. The bushing 300 can be substantially similar to, and can include some or all of, the features of the bushing 200 shown in FIGS. 2A-2D. For example, the bushing 300 can include a body 302 having a first end 304A and a second end 304B. In some examples, the body 302 can be cylindrical in shape and can be substantially symmetric about a longitudinal axis $L_A$. The body 302 can have one or more features or attributes. For example, the body 302 can include a flange 306 disposed at the first end 304A of the body 302. In some examples, the flange 306 can extend radially from the longitudinal axis $L_A$ and can be substantially symmetric about the longitudinal axis $L_A$. In some examples, the flange 306 can include one or more planar surfaces 308A, 308B positioned to at least partially abut the archery bow riser or a component or accessory coupled to the archery bow riser via the bushing 300. For example, a stabilizer or other archery accessory can abut the flange 306 when coupled to the archery bow riser via the bushing 300. In some examples, the one or more planar surfaces 308A, 308B can be orthogonal to the longitudinal axis $L_A$.

Additionally, or alternatively, the body 302 can define an external threaded feature 310 disposed between the first end 304A and the second end 304B. The external threaded feature 310 can have a first thread pitch. The external threaded feature 310 can occupy or define more than half of the external surface of the body 302 yet, in some examples, may not occupy the entirety of the external surface of the body 302. For example, the external threaded feature 310 can have a sixth length $L_6$ and the body 302 can have a seventh length $L_7$. The sixth length $L_6$ can be at least 9 mm, between about 9 mm and about 10 mm, between 10 mm and about 11 mm, between about 11 mm and about 12 mm, or greater than about 12 mm. The seventh length Ly can be at least 20 mm, between about 20 mm and about 25 mm, between 25 mm and about 30 mm, between about 30 mm and about 35 mm, or greater than about 35 mm. As such, in some examples, the sixth length $L_6$ can be less than the seventh length $L_7$. In some examples, the sixth length $L_6$ can be between half to three-quarters of the seventh length $L_7$. In other words, the seventh length $L_7$ can be between 1.25 times greater to 2 times greater than the sixth length $L_6$. In some examples, the external surface of the body 302 can be devoid of threads (e.g., relatively smooth) adjacent to the second end 304B to enable the second end 304B to be more easily inserted and aligned within a hole or cavity formed within the archery bow riser before the external threaded feature 310 engages with the riser 100.

In some examples, a major diameter $D_m$ of the external threaded feature 310 can generate an interference fit within the blind hole or through hole of the composite archery bow riser 100. The interference fit can couple the bushing 300 within the blind hole or through hole and provide engagement limiting or preventing removal of the bushing 300 from the blind hole or through hole. For example, the interference between the external threaded feature 310 and the composite archery riser 100 can resist rotation that would otherwise decouple or unthread the bushing 300 from the blind hole or through hole of the composite archery bow riser 100.

In some examples, the interference can be between 0.125 millimeters (mm) and 0.765 mm, such as, an interference of 0.435 mm. In other words, the major diameter $D_m$ of the external threaded feature 310 can be between 0.125 mm and 0.765 mm larger than an outer diameter (OD) of the blind hole or through hole of the composite archery bow riser 100 receiving the bushing 300. In some examples, the external threaded feature 310 can taper along the thread length (see length $L_6$). The major diameter $D_m$ can be measured as the largest major diameter along the thread length. Additionally, or alternatively, the major diameter $D_m$ can be measured as the average major diameter along the thread length. Additionally, or alternatively, the major diameter $D_m$ can be measured as the smallest major diameter along the thread length. In some examples, the blind hole or through hole within the composite riser 100 can be tapered.

In some examples, the body 302 can define a first aperture 312 and a second aperture 318. The first aperture 312 can be formed or defined at the first end 304A of the body 302 while the second aperture 318 can be formed or defined at the second end 304B of the body 302. A component or accessory can include a threaded stud (not shown) receivable within the first aperture 312. For example, a channel or bore 314 defined within the body 302 can be accessible via the first aperture 312. In some examples, the bore 314 can be a blind hole (see FIGS. 2A-2D). In some examples, the bore 314 can be a through hole (see FIGS. 3A-3D). The bore 314 can enable access to a drive feature (see drive feature 320 in FIG. 3D). For example, a hand tool, drill accessory, or other tool can be inserted into the bore 314 and engage the drive feature 320 to rotate the bushing 300 as a coupling/decoupling mechanism for installing/uninstalling the bushing 300 relative to the archery bow riser.

In some examples, the bore 314 can include an internal threaded feature 316 disposed between the first end 304A and the second end 304B. In other words, the internal threaded feature 316 can be disposed within the bore 314 and between the flange 306 and a second aperture 318 defined by the bore 314 at the second end 304B. The bore 314 can connect (e.g., fluid communication) the first aperture 312 to the second aperture 318. The internal threaded feature 316 can have a second thread pitch different from the first thread pitch of the external threaded feature 310. In some examples, the internal threaded feature 316 can occupy or define more than half, yet not the entirety, of the bore 314. For example, the internal threaded feature 316 can have an eighth length $L_8$ and the bore 314 can have a ninth length $L_9$. In some examples, the eighth length $L_8$ can be between half to three-quarters of the ninth length $L_9$. In other words, the ninth length $L_9$ can be between 1.25 times greater to 2 times greater than the eighth length $L_8$. The eighth length $L_8$ can be at least 12 mm, between about 12 mm and about 14 mm, between 14 mm and about 16 mm, between about 16 mm and about 18 mm, or greater than about 18 mm. The ninth length $L_9$ can be at least 18 mm, between about 18 mm and about 20 mm, between 20 mm and about 22 mm, between about 22 mm and about 24 mm, or greater than about 24 mm. In some examples, the bore 314 can be devoid of threads adjacent to the second end 304B. That is, the bore 314 can define or form a drive feature 320 (see FIG. 3D) near the second end 304B having one or more planar surfaces devoid of threads.

In some examples, the second end 304B can include one or more planar surfaces 322 extending substantially orthogonal to the longitudinal axis $L_A$. In some examples, the one or more planar surfaces 322 of the second end 304B can be parallel to the one or more planar surfaces 308A, 308B of the flange 306. In some examples, the one or more planar surfaces 322 can extend radially from the longitudinal axis $L_A$ and can be substantially symmetric about the longitudinal axis $L_A$. In some examples, the second end 304B can include a periphery having an edge 324 that is chamfered, rounded, sunk, concaved, beveled, or a combination thereof. The characteristic of the edge 324 can be beneficial, for example, by providing clearance and mitigating interference between the bushing 300 and the riser (e.g., a countersink within a blind hole of the riser). In some examples, the edge 324 can be substantially symmetric about the longitudinal axis $L_A$.

In some examples, the body 302 can taper along its length (e.g., seventh length $L_7$). For example, the first end 304A can have a third thickness $T_3$ and the second end 304B can have a fourth thickness $T_4$ that is less than the third thickness $T_3$. The taper can be constant along the length of the body 302 in some examples. In other examples, the taper can be nonconstant or otherwise discontinuous along the length of the body 302. For example, the taper can be interrupted or bisected by the external threaded feature 310 and/or another feature formed or defined on the body 302. The third thickness $T_3$ can be at least 7 mm, between about 7 mm and about 9 mm, between 9 mm and about 11 mm, between about 11 mm and about 13 mm, or greater than about 13 mm. The fourth thickness $T_4$ can be at least 5 mm, between about 5 mm and about 7 mm, between 7 mm and about 9 mm, between about 9 mm and about 11 mm, or greater than about 11 mm. As such, in some examples, the third thickness $T_3$ can be greater than the fourth thickness $T_4$. The fourth thickness $T_4$ can be greater than about 75%, between about 75% and about 80%, between 80% and about 85%, between about 85% and about 90%, or greater than about 90% of the third thickness $T_3$.

The bushing 300 includes the drive feature 320 formed or otherwise defined within the bore 314. The drive feature 320 can provide an interface for the head of a tool (e.g., a tool head configured to engage a slotted, cross-slot, star (Torx®), security, hexagon, square, a combination thereof, or any other type of drive) to enable installation/rotation of the bushing 300 relative to the archery bow riser (e.g., archery bow riser 100). For example, as depicted in FIG. 3D, the drive feature 320 can form or define a hexagonal engagement (e.g., a hexagonal cross-section) such that a hex drive can be at least partially disposed within the drive feature 320. A tool can be at least partially inserted into the bore 314, past the internal threaded feature 316, and into the drive feature 320. In some examples, the drive feature 320 can be formed or defined within the bore 314 by one or more planar sidewalls 326 (e.g., 6 sidewalls for a hexagonal cross-section configuration) within the bore 314 and adjacent the second aperture 318. Thus, the drive feature 320 is disposed nearer the second end 304B than the first end 304A, despite the drive feature 320 being accessible via the first aperture 312 formed within the first end 304A. The one or more planar sidewalls 326 can be parallel to the longitudinal axis $L_A$ of the body 302.

The drive feature 320 has a tenth length Lio that is less than, or equal to, the eighth length $L_8$ of the internal threaded feature 316. The tenth length Lio can be at least 4 mm, between about 4 mm and about 5 mm, between 5 mm and about 6 mm, between about 6 mm and about 7 mm, or greater than about 7 mm. The tenth length Lio can be greater than about 30%, between about 30% and about 40%, between 40% and about 50%, between about 50% and about 60%, or greater than about 60% of the eighth length $L_8$.

The drive feature 320 has a third width $W_3$ that is less than, or equal to, a fourth width $W_4$ of the internal threaded feature 316 such that a tool can be inserted into the bore 314, past the internal threaded feature 316, and into the drive feature 320 to couple or decouple the bushing 300 to the archery bow riser. The third width $W_3$ can be at least 4 mm, between about 4 mm and about 5 mm, between 5 mm and about 6 mm, between about 6 mm and about 7 mm, or greater than about 7 mm. The fourth width $W_4$ can be at least 4 mm, between about 4 mm and about 5 mm, between 5 mm and about 6 mm, between about 6 mm and about 7 mm, or greater than about 7 mm. The third width $W_3$ can be greater than about 80%, between about 80% and about 85%, between 85% and about 90%, between about 90% and about 95%, or greater than about 95% of the fourth width $W_4$.

In some examples, changes may be made in the function and arrangement of archery components or products discussed without departing from the spirit and scope of the disclosure, and various embodiments may omit, substitute, or add other components or accessories as appropriate. For instance, one or more features incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. An archery bow, comprising:

a riser; and a bushing coupled to the riser, comprising:

a bore defining an aperture;

a drive feature disposed within the bore; and a threaded feature disposed between the aperture and the drive feature.

2. The archery bow of claim 1, wherein the bore defines a blind hole in the bushing, the drive feature defining a base of the blind hole.

3. The archery bow of claim 2, wherein the base defines a planar surface orthogonal to a longitudinal axis of the bore.

4. The archery bow of claim 1, wherein the aperture is a first aperture and the bore defines a second aperture to form a through hole.

5. The archery bow of claim 1, wherein the threaded feature is disposed within the bore.

6. The archery bow of claim 5, wherein the threaded feature is a first threaded feature, the bushing comprises a second threaded feature disposed on an external surface of the bushing.

7. The archery bow of claim 6, wherein the first threaded feature has a first characteristic and the second threaded feature has a second characteristic different from the first characteristic.

8. The archery bow of claim 1, wherein the drive feature has a hexagonal cross-section.

9. The archery bow of claim 1, wherein:
the drive feature defines a first length;
the threaded feature defines a second length; and
the first length is less than the second length.

10. The archery bow of claim 1, wherein:
the drive feature defines a first width;
the threaded feature defines a second width; and
the first width is less than or equal to the second width.

11. An archery bow, comprising:
a riser; and
a bushing coupled to the riser, the bushing comprising:
a body have a first end and a second end;
a flange disposed on the first end; and
a drive feature disposed on the second end.

12. The archery bow of claim 11, wherein the body defines a bore having a blind hole, the drive feature defining a base of the blind hole.

13. The archery bow of claim 11, wherein the second end defines a planar surface extending orthogonal to a longitudinal axis of the body.

14. The archery bow of claim 13, wherein the drive feature has a sidewall spanning perpendicular to the planar surface.

15. The archery bow of claim 11, wherein:
the first end includes a first aperture;
the second end includes a second aperture; and
the body defines a bore connecting the first aperture to the second aperture.

16. The archery bow of claim 11, wherein the body includes an external threaded feature disposed between the first end and the drive feature.

17. The archery bow of claim 11, wherein the body includes an internal threaded feature disposed between the first end and the drive feature.

18. The archery bow of claim 11, wherein the body tapers from a first thickness at the first end to a second thickness at the second end, the first thickness greater than the second thickness.

19. A bushing for an archery bow, comprising:
a body having a bore;
a threaded feature disposed within the bore, the threaded feature having a first width; and
a drive feature disposed within the bore, the drive feature having a second width, the first width greater than or equal to the second width.

20. The bushing of claim 19, further comprising a flange, the threaded feature disposed between the flange and the drive feature.

* * * * *